United States Patent [19]

Henault

[11] 4,448,156

[45] May 15, 1984

[54] VARIABLE GAS DISTRIBUTION DEVICE FOR INTERNAL COMBUSTION MOTORS

[75] Inventor: Claude Henault, Jouy en Josas, France

[73] Assignee: Regie Nationale des Usines Renault, Boulogne-Billancourt, France

[21] Appl. No.: 316,278

[22] Filed: Oct. 29, 1981

[30] Foreign Application Priority Data

Nov. 13, 1980 [FR] France ..... 80 24129

[51] Int. Cl.[3] ..... F01L 1/34

[52] U.S. Cl. ..... 123/90.17; 123/90.18; 123/198 F; 123/90.27

[58] Field of Search ..... 123/198 F, 90.15, 90.16, 123/90.17, 90.27, 90.18

[56] References Cited

U.S. PATENT DOCUMENTS

| | | | |
|---|---|---|---|
| 1,283,780 | 11/1918 | Huid | 123/198 F |
| 1,622,492 | 3/1927 | Coatalen | 123/90.15 |
| 4,151,817 | 5/1979 | Muellen | 123/198 F |
| 4,151,824 | 5/1979 | Gilbert | 123/198 F |
| 4,173,209 | 11/1979 | Jordan | 123/198 F |
| 4,203,397 | 5/1980 | Soetens | 123/198 F |
| 4,204,512 | 5/1980 | Brock | 123/198 F |
| 4,249,488 | 2/1981 | Siegla | 123/198 F |
| 4,252,093 | 2/1981 | Hazelrigg | 123/198 F |
| 4,284,042 | 8/1981 | Springer | 123/198 F |

FOREIGN PATENT DOCUMENTS

| | | |
|---|---|---|
| 892094 | 7/1949 | Fed. Rep. of Germany . |
| 2753197 | 6/1978 | Fed. Rep. of Germany . |
| 393826 | 8/1908 | France . |
| 2406087 | 5/1979 | France . |
| 264716 | 10/1949 | Switzerland . |

*Primary Examiner*—Ira S. Lazarus

*Attorney, Agent, or Firm*—Oblon, Fisher, Spivak, McClelland & Maier

[57] ABSTRACT

A variable gas distribution device, or a variable valve timing device, for an internal combustion engine is disclosed. The device consists of at least two rocker arms mounted on a common shaft and each engageable with a cam having a different configuration. A connecting element is slidably mounted on the shaft between two of the rocker arms and is engageable with an intake valve of an engine. The connecting element and rocker arms have lateral notches which are matable with one another so that the connecting element rotates with one or the other of the rocker arms. A control device is provided for moving the connecting element along the axis of the shaft so that it can engage with one or the other of the rocker arms.

5 Claims, 3 Drawing Figures

VARIABLE GAS DISTRIBUTION DEVICE FOR INTERNAL COMBUSTION MOTORS

BACKGROUND OF THE INVENTION

1. Field of the Invention

The object of the present invention is a variable gas distribution or valve timing device making it possible to modify the gas distribution in an internal combustion motor with controlled ignition while the engine is running.

2. Description of the Prior Art

Numerous devices modify the distribution of intake and exhaust gases in an internal combustion motor, thus adapting it for all operating conditions and particularly for use under partially loaded operating conditions.

Generally, gas distribution is carried out by a cam shaft with an intake cam and an exhaust cam guiding respectively, either directly or by means of a rocker arm, intake valves and exhaust valves. To assure timing of the valves in phase and with correct amplitude for all operating conditions, it would require an infinite number of cams which would result in a complex and unwieldy mechanism.

All devices of the type known until now, whether mechanical, hydraulic or electric, which attempt to provide the continuously variable functioning of the gas distribution system are complicated and expensive.

SUMMARY OF THE INVENTION

The invention envisions providing a simple device which not only includes continuously variable gas distribution but also a two stage device having two cams.

The variable distribution device according to the invention includes at least two rocker arms each controlled by an appropriately configured cam corresponding to a particular motor load, and a common connecting element slidingly mounted on the rocker arm shaft and arranged to control the intake valve of a motor cylinder, said connecting element being associated with control means causing it to be connected and disconnected to one or the other rocker arm while the engine is running.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
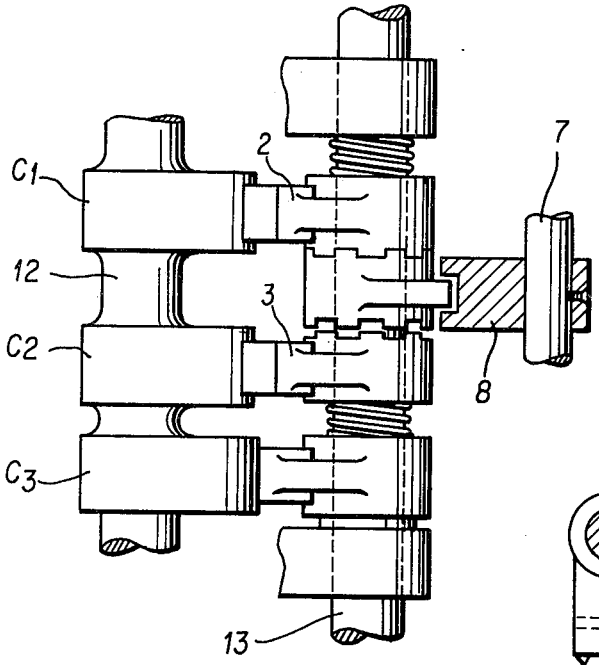
FIG. 1 is a lateral view of the variable distribution device according to the invention.
Figure 3:
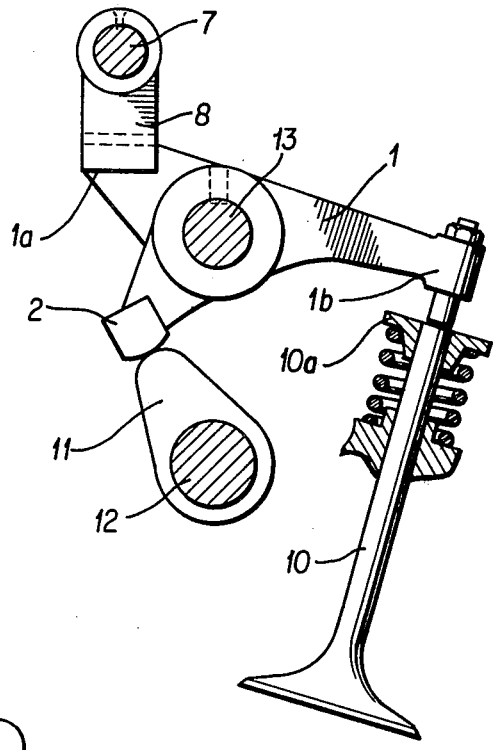
FIG. 3 is a partially transverse sectional lateral view of the device in FIG. 1.
Figure 2:
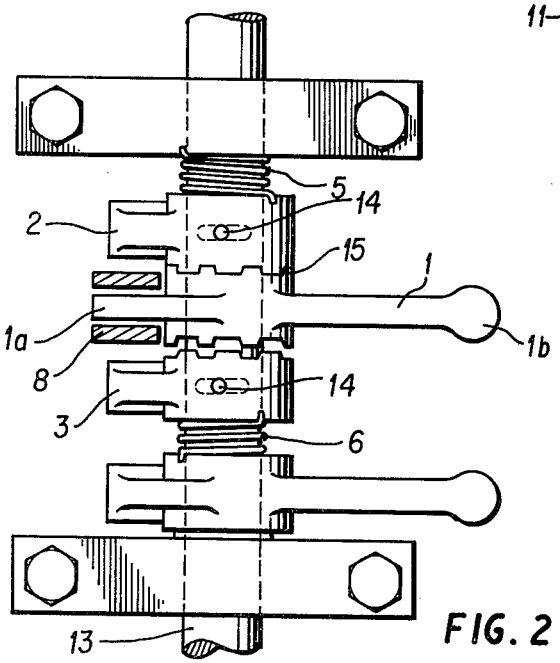
FIG. 2 is a top view of the device in FIG. 1.

Two intake cams C1 and C2 and an exhaust cam C3 are mounted on the cam shaft of the variable distribution device according to the invention.

The intake cams C1 and C2 on cam shaft 12 respectively activate two rocker arms 2 and 3 which are articulated to a shaft 13 and prevented from axial shifting by pins 14 located in corresponding grooves on the internal face of the rocker arm. On their lateral faces, the rocker arms 2 and 3 are provided with coupling means, for example a notched structure 15, designed to mate with a corresponding structure on the lateral faces of a connecting element 1 common to the two rocker arms 2 and 3.

This connecting element 1 can be moved along the axis of shaft 13 by means of a control device including shaft 7 and fork 8 permitting coupling either with the rocker arm 3 or the rocker arm 2, so as to respectively control the valve 10 either with cam C1 or with cam C2.

To this end the connecting element 1, slidingly mounted on shaft 13, is shaped so as to include, on the one hand, a portion l*a* which cooperates with the fork 8 rigidly mounted on shaft 7 and, on the other hand, a portion 1*b* supporting a rocker arm screw allowing sliding adjustment of the screw to a distance sufficient to be at the level of the cupel 10*a* and the valve end 10.

Springs 5 and 6 are respectively provided to keep the rocker arm 2 and 3 supported on their respective cams C1 and C2.

The control device 7 and 8 which moves element 1 along the shaft 13 may be activated in any appropriate manner, for example mechanically, hydraulically (using motor oil pressure) or electrically.

In the above device, since the cams are rationally dimensioned (i.e. one optimal for partial load, the other for full load) a propitious compromise of functioning over the entire operating range and motor load spectrum is assured.

It is evident that the invention is in no way limited to the embodiment described above, and that it encompasses all modifications and variations issuing from the same basic principle. It is also possible for one to anticipate that the connecting element 1 could have sufficient throw on the rod 13 that it would not couple with either of the rocker arms, thus putting the cylinder out of service.

What is claimed as new and desired to be secured by Letters Patent of the United States is:

1. A variable valve timing device for an internal combustion engine, comprising:

at least two rocker arms mounted on a common rocker arm shaft;

two cams, each of said cams being engageable with one of said rocker arms for rotating said rocker arm about said shaft, each said cam having a different configuration;

a connecting element slidably mounted on said shaft between two of said rocker arms, said connecting element including a first portion and a second portion;

control means engageable with said first portion for moving each said connecting element along the axis of said shaft;

an engine cylinder valve engageable with said second portion for actuating said valve when said connecting element is rotated; and coupling means associated with said rocker arms and said connecting element for rotatably coupling said connecting element to one of said rocker arms.

2. The device of claim 1 wherein said coupling means comprises mating notched structure on the axial ends of said rocker arms and connecting element.

3. The device of claim 1 wherein said control means are activated mechanically.

4. The device of claim 1 wherein said control means are activated hydraulically.

5. The device of claim 1 wherein said control means are activated electrically.

* * * * *